United States Patent [19]

Dian

[11] 4,324,404

[45] Apr. 13, 1982

[54] GOLF PUTTER

[75] Inventor: Walter Dian, Downers Grove, Ill.

[73] Assignee: Walter Dian, Inc., Downers Grove, Ill.

[21] Appl. No.: 151,373

[22] Filed: May 19, 1980

[51] Int. Cl.[3] ..... A63B 53/04

[52] U.S. Cl. ..... 273/169; 273/80.2; 273/164; 273/171; 273/DIG. 14

[58] Field of Search ..... 273/77 R, 78, 80 C, 273/163 R, 164, 167–175, 183 D, 80.2, DIG. 14, 67 R, 67 C, 83

[56] References Cited

U.S. PATENT DOCUMENTS

| | | | |
|---|---|---|---|
| 645,944 | 3/1900 | Dalgleish | 273/169 |
| 1,064,916 | 6/1913 | Kelly et al. | 273/167 C X |
| 1,454,267 | 5/1923 | Challis et al. | 273/164 X |
| 1,530,952 | 3/1925 | Lawton | 273/167 F X |
| 1,652,404 | 12/1927 | Graveure | 273/169 X |
| 1,703,199 | 2/1929 | McClure | 273/80 C X |
| 1,918,179 | 7/1933 | Buckler | 273/67 R |
| 2,346,617 | 4/1944 | Schaffer | 273/80.2 |
| 2,460,435 | 2/1949 | Schaffer | 273/169 |
| 3,399,898 | 9/1968 | Burkland | 273/167 F X |
| 3,758,115 | 9/1973 | Hoglund | 273/80 C X |
| 3,819,180 | 6/1974 | Murphy | 273/80 C |
| 3,866,922 | 2/1975 | Marci et al. | 273/164 |
| 3,873,094 | 3/1975 | Sebo et al. | 273/80.2 X |
| 4,173,343 | 11/1979 | Richilano | 273/169 |
| 4,222,566 | 9/1980 | Berry | 273/164 |

FOREIGN PATENT DOCUMENTS

| | | | |
|---|---|---|---|
| 727051 | 3/1955 | United Kingdom | 273/80 C |
| 1209466 | 10/1970 | United Kingdom | 273/80 C |

*Primary Examiner*—Richard J. Apley

*Attorney, Agent, or Firm*—Hill, Van Santen, Steadman, Chiara & Simpson

[57] ABSTRACT

A golf club putter is provided with a head having an elongated rod-like weight extending transversely of the axis of the club shaft in a front to rear direction with a ball impacting front face and toe and heel wings radiating from diametrically opposite sides of the transversely extending weight rod each with bottom faces above the bottom of the weight rod to accommodate lateral rocking of the club throughout a wide angle without rubbing against the putting surface and turning the ball impacting face as the ball is impacted. The elongated transversely extending weight rod is visible to the golfer along its length to facilitate alignment of the club head with the desired putting line. The weight delivers a desired mallet or battering ram impact to the ball without requiring a large sole area on the putter head. The shaft extends from the upper portion of the weight ahead of the longitudinal mid-point thereof and preferably in front one-third of the length of the weight and is preferably positioned so that the putter face will be normal to the longitudinal axis of the shaft, with the shaft being inclined from the putter head so as to position the head a comfortable distance in front of a golfer grasping the grip of the shaft.

4 Claims, 21 Drawing Figures

GOLF PUTTER

BACKGROUND OF THE INVENTION

1. Field of the Invention

This invention relates to the golf club art and particularly to golf club putters with mallet type heads.

2. Description of the Prior Art

Prior known golf club putters fall generally into two classes, namely, the narrow blade type and the large head mallet type. Each have disadvantages. The blade type putter is easily misaligned in both horizontal and vertical planes having little sole area to guide the golfer in addressing the ball. The large head mallet type putter, on the other hand, has a large sole area that can rest on the putting surface in addressing the ball but this enhances dragging against the putter surface to spoil the putt. Both the blade and mallet putters when tilted toward or away from the golfer and scuffed against the putter surface will turn or twist the putting face just before or during impact of the ball and propel the ball at an angle to the desired line of putt. The present invention now eliminates the disadvantages of both blade and and mallet type putters by providing a front to rear elongated putter head with a minimal sole portion that can be rocked transversely through a wide angle without any scuffing causing the putter head to twist or turn and at the same time providing an elongated front to rear sighting axis positioning the putting face normal to the line of putt.

SUMMARY OF THE INVENTION

This invention now provides a golf club putter meeting all of the requirements of the rules of the U.S. Golf Association and having the advantages of both blade type and mallet type putters without the disadvantages of either type and providing sighting and "sweet spot" features not heretofore provided.

According to the invention, a generally rectangular putter head is provided with a central elongated heavy weight extending transversely in a front to rear direction on the bottom end of a club shaft having a conventional hand grip at the other end. The head has laterally extending toe and heel wings radiating from diametrically opposite sides of the elongated weight above a very narrow sole portion along the axis of the weight so that the club may be rocked toward and away from the golfer through a wide angle without having more than about line contact with the putting surface. The front end of the weight provides a first ball impact face normal to the axis but if desired this face can be covered with a cap which may also cover the front faces of the wings.

The shaft extends upwardly from the upper portion of the weight, forwardly of its longitudinal center, and preferably within the front one-third of the length of the weight. The shaft may have a short shank portion perpendicular to the longitudinal axis of the weight and merged into an elongated main length portion terminating in the hand grip at angles of 50° to 80° from a horizontal plane through the longitudinal center line of the head. Other shaft arrangements include a straight shaft emerging from the weight at an angle and a shaft offset forwardly to align the shaft axis with the vertical putting face. In an embodiment the shaft can be rotated to position the putting face for either right or left hand golfers. These shaft arrangements provide for a comfortable positioning of the putter head in front of the golfer with the narrow sole of the putter head resting on the putting surface to align the weight rod axis with the intended putting line.

The front to rear extending weight is preferably composed of metal such as steel or brass and is preferably encased in a clear plastic material which may be of any suitable high impact resisting casting or injection molding type resin such as a polyester or a nylon or an epoxy resin. The plastic body is lighter than the weight and it may have a reducing optical lens shape overlying the weight to provide a narrower sighting line to the golfer along the top of the weight.

To counteract the effect of the shaft in raising the so-called "sweet spot" on the putting face of the head, a heavy insert such as a lead filler may be placed in or on the weight along the bottom portion thereof. The elongated weight rod can be balanced to suit the golfer and provide an increased area "sweet spot".

In a preferred embodiment, the weight is a cylindrical rod about two to three inches in length and about one-half to one inch in diameter. However, the cross-sectional shape of the weight need not be circular. The weight rod may weigh about 200 to 275 grams with the total head weighing about 290 to 350 grams. The weight ratio of rod to head is thus about 70% to 90% of the total weight of the head being in the weight rod.

A preferred putter head may be about three to four inches wide, two to three and a half inches deep in a front to rear direction and three quarters to one and a half inches high at its transverse center with the radiating wings being much thinner in the order of three-eighths to three-quarters inches and having bottom faces raised sufficiently about the longitudinal sole line of the weight carrying central portion so that the club head can be rocked through an appreciable angle without contacting the wings against the putting surface.

It is then an object of this invention to provide a golf club putter combining the advantages of blade and mallet type putters without the disadvantages of either type.

Another object of this invention is to provide a golf club putter with a generally rectangular putter head having a thickened longitudinally extending heavy central portion providing an inertia hammer or battering ram effect when impacting the ball.

Another object of the invention is to provide a putter with a heavy transversely extending weight on the end of a shaft encased in a lighter body material with narrow toe and heel wings radiating from the weight rod.

Another object is to provide a putting and shaft combination that can be adjusted for right and left hand golfers.

A still further object is to provide a putter having a battering ram capacity of increasing the "sweet spot" area of the putting face.

A specific object of the invention is to provide a putter head with a heavy longitudinally extending central rod encased in clear plastic material and positioned on the end of a shaft to provide a ball impacting face at the front end of the rod.

Another specific object of the invention is to provide a putter head having a heavy metal cylindrical rod extending longitudinally on the end of a shaft in a front to rear direction and encased in a clear plastic body defining thin wings radiating from diametrically opposite longitudinal sides of the rod and with this shaft anchored in the rod forwardly of its longitudinal mid-point.

A still further object of the invention is to provide a putter head with a heavy metal rod encased in a clear plastic body providing a front ball impacting face, an elongated sighting line and a bottom surface which can be transversely rocked about the axis of the rod without engaging the putting surface.

A specific object of the invention is to provide a putter head with a longitudinally extending weight on the end of the club shaft and a counterweight opposite the shaft to properly locate the "sweet spot" on the ball impacting face.

Other and further objects of this invention will become apparent to those skilled in this art form from the following detailed description of several preferred embodiments of the invention shown on the drawings in which:

AS SHOWN ON THE DRAWINGS

Figure 2:
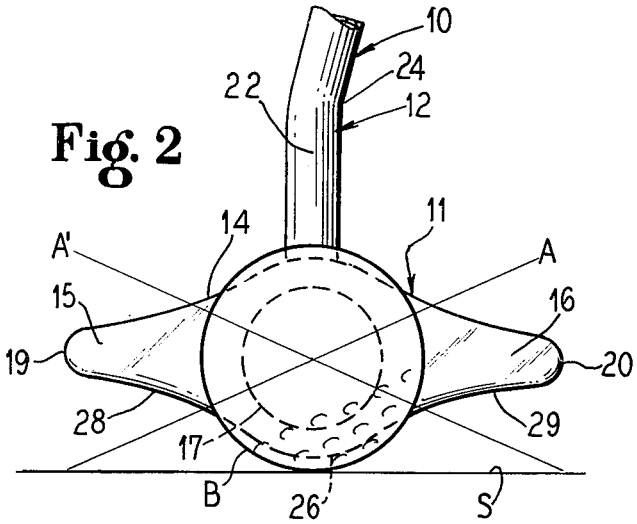
FIG. 2 is a front elevational view of the ball and putter of FIG. 1 with the upper portion of the shaft omitted and illustrating the manner in which the putter head accommodates transverse rocking on a putting surface without scuffing.

The putter 10 of FIGS. 1–5 has a generally rectangular head 11 and an elongated shaft 12 extending upwardly from the head 11.

The head 11 has a front striking or impact face 13 for engaging a conventional golf ball B at the transverse center zone thereof. The head 11 has an appreciable front to rear depth dimension with a central thick generally cylindrical portion 14 from which projects a relatively narrow or thin toe wing 15 and a heel wing 16 along diametrically opposite sides of the generally cylindrical thickened center portion 14. This center portion 14 encases a heavy elongated weight 17 with a front face 18 flush with the striking face 13 at the thickened center of the cylindrical portion 14. The weight 17 extends transversely of the axis of the shaft 12 in a front to rear direction. The front end face of the rod is normal to its axis so that alignment of the rod on the desired line of putt will cause the end face 18 to squarely impact the ball for propelling it along the putting line.

The tip ends 19 and 20 of the toe and heel wings 15 and 16 extend rearwardly from the front face 13 to a back face 21 thus providing a generally rectangular shape for the putter head body.

The shaft 12 has a short upright portion 22 extending perpendicularly upward from the rod 17 forwardly of the longitudinal mid-point of this rod and preferably within the front one-third of the length of the rod. This shank portion may only be one to three inches in length and merges into the main elongated portion 23 of the shaft 12 at a bend 24 having an angle such that the main shaft length above the bend will be inclined about 50° to 80° from a horizontal plane through the longitudinal center of the head 11. Thus the grip 25 on the top end of the shaft 12 is offset from the putter head. This arrangement accommodates addressing the ball B with the putter head resting on the putting surface in front of the golfer where he has a full birdseye or top view of the elongated rod 17.

Figure 3:
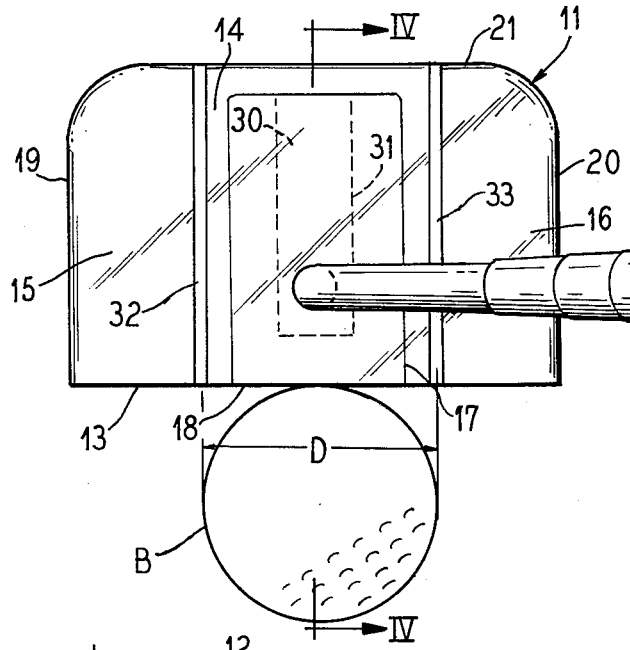
FIG. 3 is a top plan view of the putter and ball of FIG. 1.

The body material encasing the rod 17 is, as explained above, a clear plastic so that the entire length of the rod is visible from the top surface of the head 11. As shown in FIG. 3, the back 21 of the putter body covers the back end of the rod.

As shown in FIG. 2, the bottom of the thickened central portion 14 of the putter head 11 is generally cylindrical and is positioned well below the bottom faces of the wings 15 and 16 thereby providing line or narrow area contact with the putting surface S at 26. Since as explained above, the wings 15 and 16 are thinner than the central section 14 and since the wings radiate from diametrically opposite sides of this thickened portion 14 their bottom faces 28 and 29 will be materially above the putting surface S when the bottom 26 rests on this surface. This then accommodates swinging or lateral tilting of the putter head 11 in either direction through relatively wide angles indicated by the line A and A′ before the wings will contact the putting surface S. Thus, the putter may be rocked laterally to accommodate the stance of the golfer without dragging the wings on the putting surface.

Figure 4:
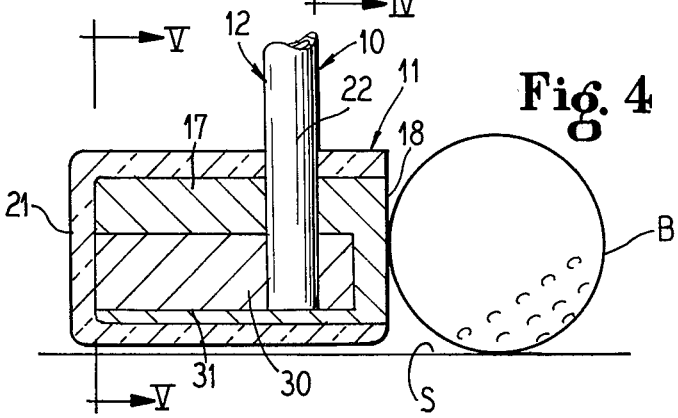
FIG. 4 is a longitudinal cross-sectional view, with parts and elevation, taken generally along the lines IV—IV of FIG. 3.
Figure 5:
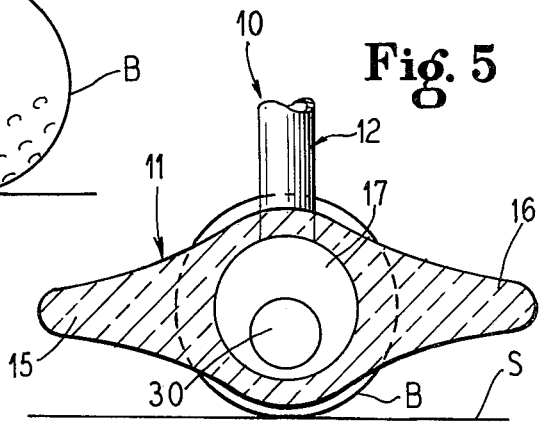
FIG. 5 is a transverse cross-sectional view taken generally along the line V—V of FIG. 4.

The weight 17 is cylindrical and as shown in FIG. 4 the shank portion 22 of shaft 12 enters the top of this weight in the front third of its length to extend perpendicularly to the axis of the weight. Since the shaft adds weight above the weight rod and has a tendency to raise the level of a "sweet spot" on the ball impacting face 18 of the rod 17, a counterweight in the form of a lead filler 30 fills a longitudinal bore 31 in the bottom half of the rod 17. This bore 31 has its axis at the longitudinal center of the weight 17 but below the center of mass of the weight. As illustrated in FIG. 4, the shank portion 22 may extend into the lead filler 30 and the filler projects forwardly of the shaft and rearwardly to the rear end of the weight 17. It should be understood, however, that various positionings of the counterweight filler 30 can be selected to suit individual putting styles.

Figure 1:
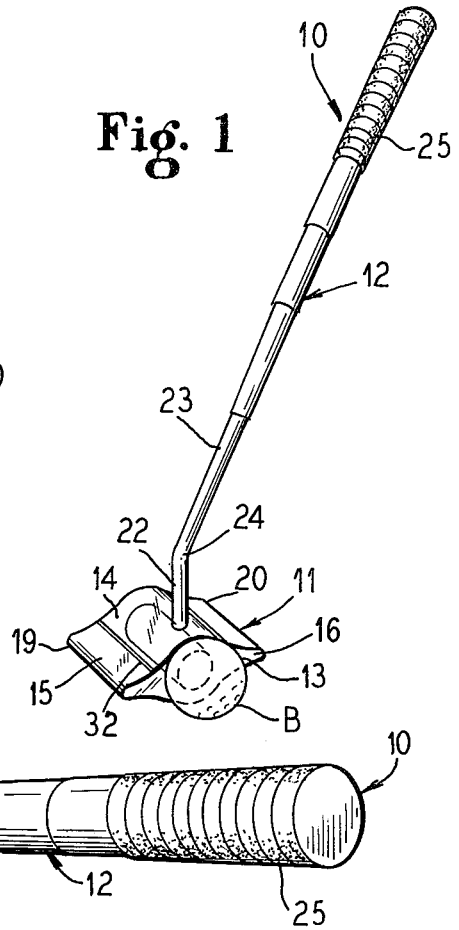
FIG. 1 is a front perspective view of a golf club putter according to this invention in position for impacting a golf ball.

When addressing the ball B for a putt, the narrow sole 26 of the putter head 14 may rest on the putting surface S with the visible weight rod 17 positioned so that its axis will be on the putting line. As a further visible guide to center the ball B on the front face 18 of the rod 17, as shown in FIGS. 1 and 3, narrow stripes 32 and 33 may be provided on the top surfaces of the toe and heel wings 15 and 16 extending in front to rear directions and spaced apart a distance D to straddle the ball B so that the golfer will have a visual indication of just how the impact face 18 is aligned transversely of the ball B. The axis of the weight 17 also gives the golfer a visible indication of the alignment of the putter head on the desired putting line.

Figure 6:
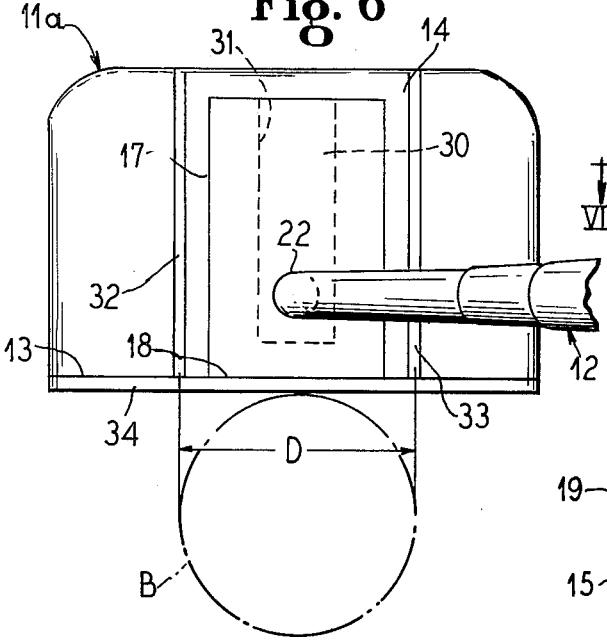
FIG. 6 is a view similar to FIG. 3 but illustrating a modified arrangement wherein the putter head is provided with a cap forming the putting face.

In the modification of FIG. 6, the putter head 11*a* is identical with the head 11 of FIGS. 1 through 5 and corresponding parts have been marked with the same reference numerals. However, the head 11*a* has a front cap 34 overlying the front faces 13 of the plastic body and 18 of the rod 17. This cap 34 can be metal or a hard plastics material protecting the clear plastics body and preferably has a distinct color so as to give the golfer another sighting line from the tip of the putter head.

Figure 7:
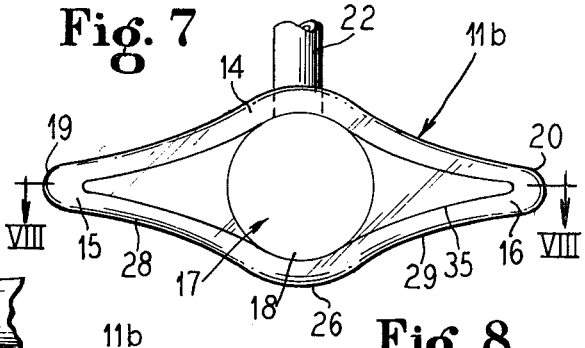
FIG. 7 is a front elevational view of a modified counter-weighted putter head.
Figure 8:
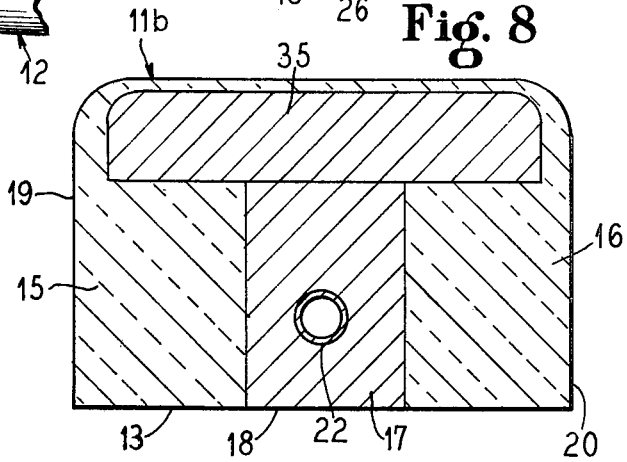
FIG. 8 is a cross-sectional view along the line VIII—VIII of FIG. 7.

In the embodiment of FIGS. 7 and 8, the putter head 11*b* has the same shape and configuration as the above described putter heads 11 and 11*a* and the same parts have been marked with the identical reference numerals. However, in the putter head 11*b*, the central weight rod 17 has a plate-like back weight 35 encased in the plastic body and generally following the contour of the body behind the cylindrical weight 17. This plate weight can be composed of the same metal, such as steel or brass, as the rod 17 and can be as thick as desired to add back weight to the putter head. The lead fillers 30 of the putter heads 11 and 11*a* can be eliminated.

Figure 9:
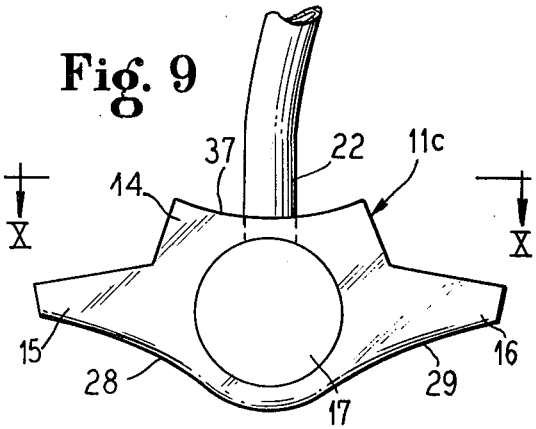
FIG. 9 is a front elevational view of a further modified putter head with an image reducing optical lens portion on the top thereof.
Figure 10:
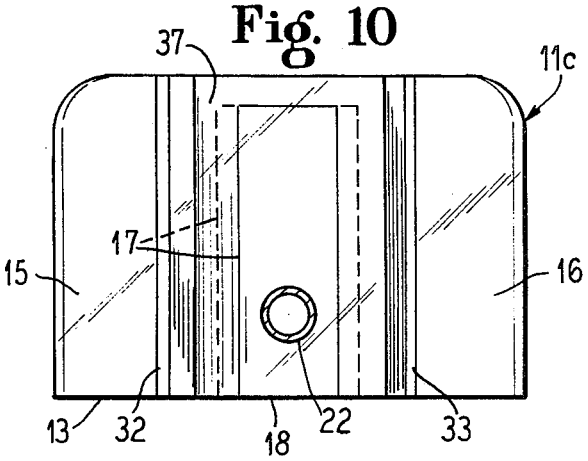
FIG. 10 is a plan view along the line X—X of FIG. 9 showing the visual reduction of the elongated weight.

In the embodiment of FIGS. 9 and 10, a further modified putter head 11*c* is illustrated as having the same generally rectangular shape and configuration as the putter heads 11, 11*a* and 11*b* and the same parts have been marked with identical reference numerals. However, in the putter head 11*c*, the cylindrical weight rod 17 assumes a reduced width appearance to the golfer by providing an image reducing concave lens portion 37 on the top face of the clear plastic body surrounding the weight rod 17. As illustrated in FIG. 10, this lens 37 contracts the diameter of the rod 17 from the dotted line size to the solid line size in FIG. 10. Thus, the golfer in addressing the ball on the putting surface will only see a reduced image of the weight rod 17. This reduced image will make possible a more accurate alignment of the axis of the rod with the putting line during the putting stroke.

Figure 11:
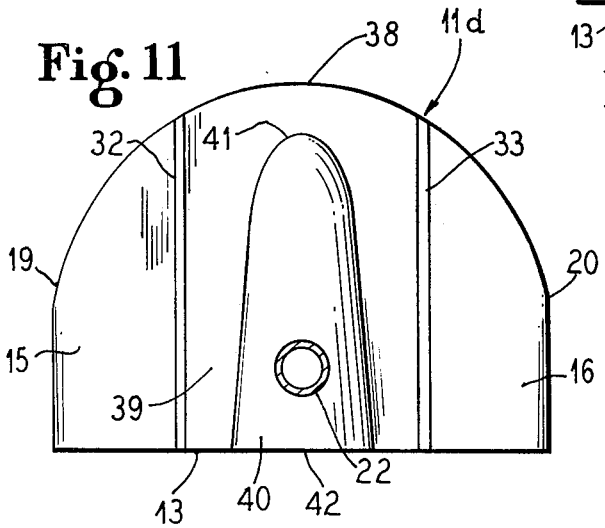
FIG. 11 is a plan view of a further modified putter head according to this invention.

In the embodiment of FIG. 11, the putter head 11*d* is a one piece metal or plastic casting generally conforming in size and shape to the above described putter heads, but having a curved back 38 and having a thickened central portion 39 which is sufficiently massive to eliminate the weight rod 17. Thus, as shown in FIG. 11, a central thickened portion 39 of the putter head has a raised integral hump 40 extending longitudinally along the top thereof. This hump receives the shaft portion 22 in its front third and is tapered rearwardly to provide a rear wall 41 of smaller size than the front. The front face 42 is similar to the front face 17 of the rod to provide the ball impacting central zone on the putter face 13.

Figure 12:
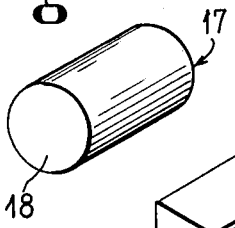
FIGS. 12, 13 and 14 are perspective views of various configurations of weight rods useful in the putter heads of this invention.
Figure 13:
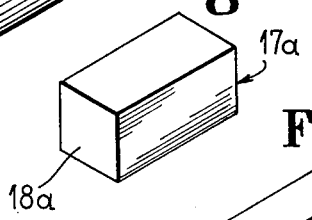
Figure 14:
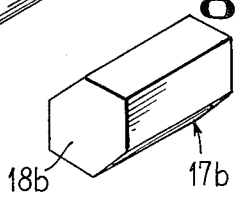

As shown in FIGS. 12 to 14, the weight rods 17 can have various configurations with the rod 17 of FIG. 12 being cylindrical, the rod 17*a* of FIG. 13 being rectangular and the rod 17*b* of FIG. 14 being hexagonal. The front ball impacting faces 18, 18*a* and 18*b* of these various rod shapes will have the circular, square, and hexagonal shapes of the rod.

Figure 15:
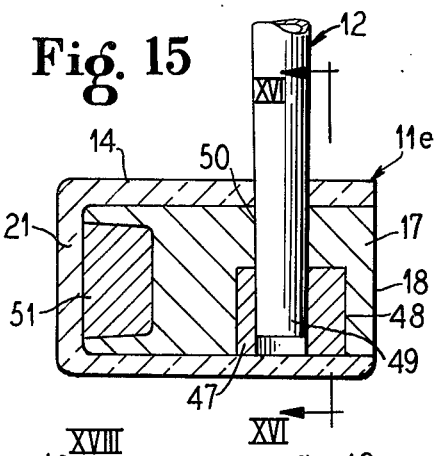
FIG. 15 is a longitudinal cross-sectional view of a still further modified putter head according to this invention and illustrating a portion of the shaft in elevation.
Figure 16:
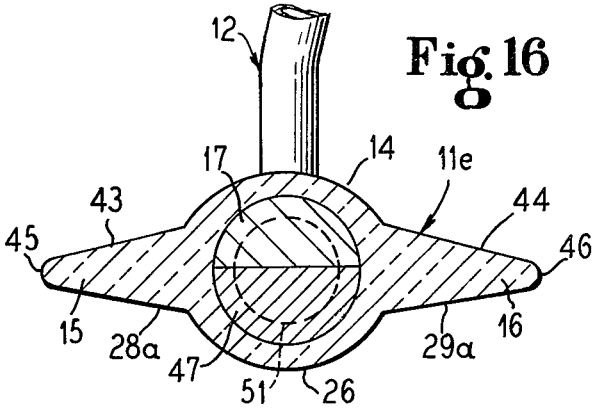
FIG. 16 is a transverse cross-sectional view along the line XVI—XVI of FIG. 15.

In the embodiment of FIGS. 15 and 16, the putter head 11*e* has the clear plastic body encasing a heavy elongated weight rod 17 as in the above described embodiment with the shaft 12 extending upwardly from the top of the head nearer the front end of the weight. However, the putter head 11*e* has a modified shape with the toe and heel wings 15 and 16 having planar bottom faces 28*a* and 29*a* sloping upwardly from the generally cylindrical thickened central portion 14. These wings also have flat planar top faces 43 and 44 converging from the thickened central portion 14 to very thin tips 45 and 46 at the ends of the wing. These flat planar top surfaces 43 and 44 afford less light reflecting surfaces to disturb the golfer and if desired, these faces may be knurled or etched to decrease light reflection.

The weight rod 17 encased in the thickened central portion of the putter head 11*e* has a heavy semicylindrical slug 47 of lead or other suitable heavy material inserted in a transverse slot 48 through the bottom half portion of the rod 17 forwardly of the longitudinal mid-point of the rod and preferably closely adjacent the ball impacting face 18 of the weight. This slug 47 receives the end 49 of the putter shaft 12 and the shaft extends upwardly through a hole 50 in the top half of the rod 17 and through the upper portion of the thickened central area 14 of the head. The slug 47 provides a counterweight offsetting the weight of the shaft portion above the head which tends to raise the "sweet spot" on the putting face 18.

In addition to counterweight 47, the rear end of the weight rod 17 receives a heavy plug 51 of lead or the like to increase the battering ram effect of the weight rod 17 in holding the line of putt even when the ball impacting end face 18 strikes the ball in radially offset relation from the longitudinal center line of the rod 17. An increased "sweet spot" area is thus provided without turning or twisting the club head at the time of impact.

Figure 17:
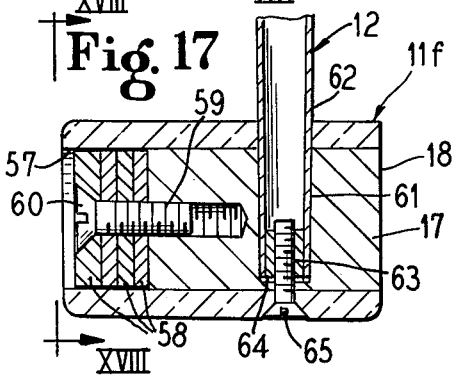
FIG. 17 is a longitudinal cross-sectional view of yet another modified putter according to this invention with the upper portion of the shaft broken away.
Figure 18:
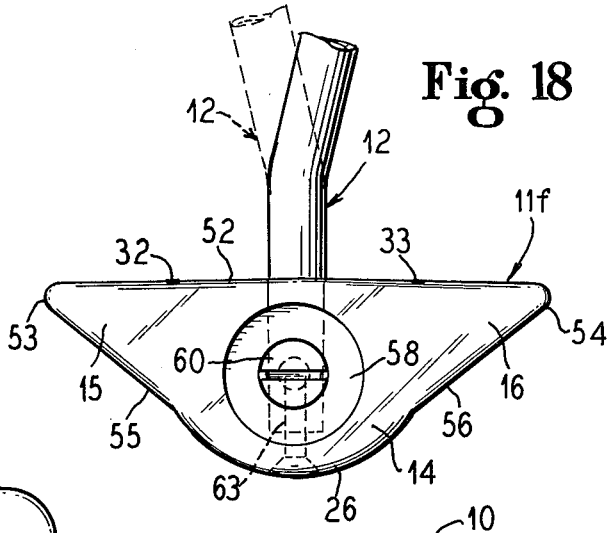
FIG. 18 is a rear elevational view along the line XVIII—XVIII of FIG. 17 and with the shaft shown in alternate positions to convert the putter for right and left hand golfers and also illustrate a modified shape for the putter head.

In the embodiment of FIGS. 17 and 18, the putter head 11*f* is composed of clear plastics material encasing a central weight rod 17 as in the other embodiments but the top face 52 of the plastics body is flat and extends to the tips 53 and 54 of the wings 15 and 16. The bottom faces 55 and 56 of these wings taper upwardly to the thin tips 53 and 54 above the bottom 26 of the thickened central portion 14 receiving the rod 17.

As shown in FIG. 17 the plastics body 11*f* does not extend over the back face of the rod 17 and this rod terminates inwardly from the back of the head providing an open end bore or hole 57 into which are fitted one or more washers 58 of heavy material such as lead. These washers are clamped against the back face of the rod 17 by a screw 59 with a head 60 accessible from the open back face of the putter head 11*a* so that the weighted washers can be changed as desired to suit the golfer.

In addition, the weight rod has a transverse hole 61 therethrough nearer the front end thereof receiving the tapered end 62 of a shaft 12 which projects through the upper portion of the head 11*f* as described above. However, this tapered shaft portion 62 is wedgelocked into the hole 61 by a screw 63 extended through the bottom of the head 11*f* and threaded into a plug 64 anchored in the bottom end of the shank portion 62. The screw 63 has a head 65 accessible from the bottom of the head 11*f*. When the screw 63 is loosened the tapered shaft portion 62 can be pulled free of the hole 61 so that the shaft can be rotated from the solid to the dotted line position of FIG. 18 thus converting the putter for use by either right or left hand golfers. In other words, the putter head can be positioned relative to the shaft so that its putting face 18 will address the ball from either a right or left hand stance.

Figure 19:
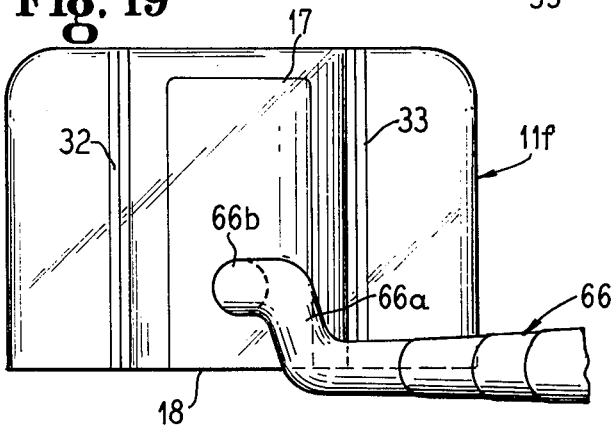
FIG. 19 is a fragmentary plan view of an alternate shaft arrangement for the putters of this invention.

In the embodiment of FIG. 19 the putter head 11*f* may be the same as any of the above described heads but it is used with an offset shaft 66 positioned so that its main portion has a longitudinal axis in the same line as the putting face 18. For this purpose the bottom end of the shaft 66 is bent back from the shaft axis along a short length portion 66*a* and then downwardly along a short length portion 66*b* into the upper portion of the putter head 11*f* where it can be anchored in the weight rod 17.

Figure 20:
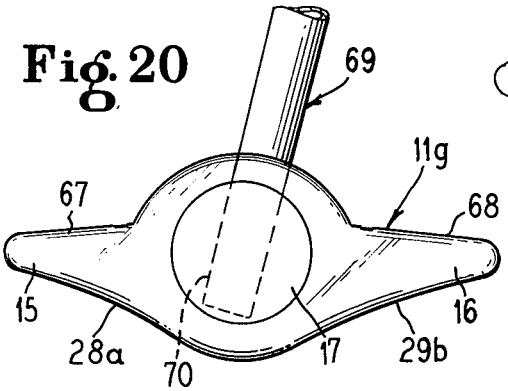
FIG. 20 is a front elevational view of still another putter according to this invention with an alternate shaft arrangement.

In the embodiment of FIG. 20 the putter head 11*g* has the same clear plastics body of the above described embodiments encasing the weight rod 17 but the shape of the body is somewhat modified to provide the heel and toe wings 15 and 16 with generally flat top surfaces 67 and 68 and flat inclined bottom surfaces such as 28*a* and 29*a* described in the embodiment of FIGS. 15 and 16. Also, a straight shaft 69 is provided anchored in a hole 70 of the weight rod 17 extending at an angle to the vertical so that the straight shaft 69 will project from the putter head 11*g* at an angle of, say, 50° to 80° from the horizontal central plane through the putter head 11*g*.

Figure 21:
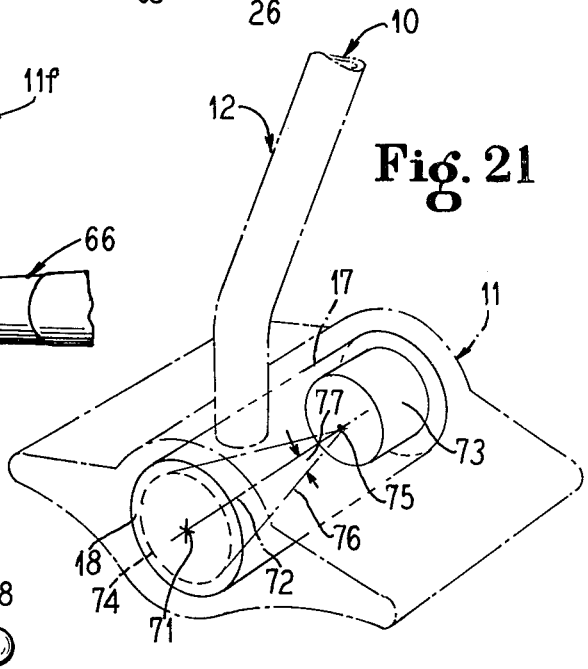
FIG. 21 is a somewhat schematic perspective view illustrating the manner in which the weights in the putters of this invention provide a battering ram or flywheel effect which increases the "sweet spot" area of the putting face and maintains the line of putt.

FIG. 21 diagrammatically illustrates the battering ram or flywheel capacity of the putters 10 of this invention to hold the putting line even when the ball is impacted by the putting face 18 radially outward from the longitudinal center line of the weight 17. Thus, as illustrated in FIG. 21 the perfect "sweet spot" on the putting face 18 is the exact center 71 of the circular putting face 18 since this lies on the longitudinal center line 72 of the rod 17. Impacting the ball radially outward from this center 71, except for the structures of this invention, would tend to twist or turn the putting face 18 causing the ball to be propelled at an angle to the line of putt. However, since the weights 17 in the putter heads of this invention have appreciable front to rear length they develop sufficient battering ram or flywheel inertia on the forward putting stroke so as not to be turned from the putting line even though the ball is impacted outwardly from the longitudinal center 71. Added weights in the rear end of the rod 17 as illustrated at 73 will enhance the battering ram or flywheel effect.

The dotted circular area 74 on the putting face 18 surrounding the longitudinal center 71 is intended to illustrate the manner in which the "sweet spot" area of the putting face 18 is increased without causing the face to turn at the time of impacting the ball. Thus, as shown, if the weight rod 17 has a radius of gyration on the center line 72 from 71 to 75 a projected cone 76 from this circular base 74 to 75 will only have a small angle 77 from the center line 72. Weights such as 73 added to the back of the weight rod 17 will increase the radius of gyration bringing the end 75 closer to the rear end of the putter head thereby even decreasing the angular deviation 77 and further decreasing the tendency of the putting face to be turned when it impacts the ball radially outward from the center 71.

An elongated radius of gyration from the longitudinal center point 71 of the putting face 18 to near the rear end of the rod 17 is thus desirable to increase the "sweet spot" area. This radius in putter heads having a front to rear dimension of two to three and one half inches can be from about one and three quarters to three inches. It should thus be understood that a large "sweet spot" area illustrated by the dotted line 74 is provided in both horizontal and vertical directions from the true "sweet spot" center 71.

While it is preferred that the clear plastic body encasing the weight rod be transparent, it should be understood that translucent or lightly opaque bodies can be used as long as the longitudinal axis of the weight rod is visible through the top of the putter head to be visually aligned with the line of putt.

From the above descriptions, a person skilled in this art will readily understand that the putters of this invention combine the advantages of blade and mallet head type putters while eliminating the disadvantages of these putters and also advancing the art by providing shaft and head features not available in heretofore known putters.

Although the invention has been described with respect to preferred embodiments, it is not to be so limited as changes and modifications can be made which are within the full intended scope of the invention as defined by the appended claims.

I claim as my invention:

1. A golf club putter comprising an elongated shaft, a generally rectangular putter head on the end of said shaft having a front putting face, a relatively thick longitudinally extending central portion, and relatively thin toe and heel wings radiating laterally from said central portion with bottom surfaces at levels above the bottom of the central portion, said head having a width from about three to about four inches, a front to rear depth from about two to about three and one-half inches, said thick longitudinally extending central portion having a height from about three-quarters to about one and one-half inches at its transverse center, said toe and heel wings having a thickness from about three-eighths to about three-quarters inches, and said bottom surfaces of said wings being raised sufficiently above the longitudinal sole line of said central portion sufficiently to accommodate rocking of the head through an appreciable angle without contacting the wings against a putting surface, said head being formed of a transparent plastics material, an elongated heavy weight rod encased in said head extending longitudinally thereof in said thick central portion and visible through said transparent plastics material of the head, said rod having an end face flush with the front of said head with a diameter from about one-half to about one inch, said rod having a length from about two to about three inches, said rod providing from about 70 to about 90% of the total weight of said head, and said shaft being anchored in said rod in the front third of the rod and extending upwardly therefrom through said transparent plastics material whereby said length and weight of the rod provides a long radius of gyration extending from said end face of the rod near the rear end of the rod for increasing the "sweet spot" area of said end face of the rod without permitting the head and rod to turn upon impact.

2. A golf club putter comprising an elongated shaft, a transparent rectangular head on said shaft having an upright front putting face, a substantial front to rear longitudinally extending depth, a thick longitudinally extending central portion with front to rear extending sides and relatively thin toe and heel wings of less height than said central portion radiating laterally from said sides and having bottom surfaces at levels above the bottom of said thick central portion, an elongated heavy weight rod encased in the thick longitudinally extending central portion of said head and extending longitudinally from said putting face in the front to rear direction and visible along the length thereof through said transparent head, said rod having an end flush with said upright putting face, said rod having a heavier mass below the longitudinal axis thereof than the mass above said axis positioned to counteract the effect of the shaft in changing the sweet spot, and said shaft being anchored in the front third of the rod and extending upwardly therefrom through said transparent head.

3. The putter of claim 2, wherein said rod has a radius of gyration extending from said upright end thereof to adjacent its rear end of about one and three-quarters inches to about three inches in length.

4. The putter of claim 2, wherein said shaft extends perpendicular to the axis of said rod.

* * * * *

UNITED STATES PATENT AND TRADEMARK OFFICE

CERTIFICATE OF CORRECTION

PATENT NO. : 4,324,404

DATED : April 13, 1982

INVENTOR(S) : Walter Dian

It is certified that error appears in the above—identified patent and that said Letters Patent is hereby corrected as shown below:

Column 5, line 41, change "tip" to --top--.

Signed and Sealed this

*Thirteenth* Day of *September 1983*

[SEAL]

*Attest:*

GERALD J. MOSSINGHOFF

*Attesting Officer*

*Commissioner of Patents and Trademarks*